United States Patent [19]

Bose et al.

[11] Patent Number: 4,473,459

[45] Date of Patent: Sep. 25, 1984

[54] SYSTEM FOR TRANSFERRING A SLURRY OF HYDROCARBON-CONTAINING SOLIDS TO AND FROM A WET OXIDATION REACTOR

[75] Inventors: Phillip R. Bose, Pleasant Hill; Walter D. Hughes, Richmond, both of Calif.

[73] Assignee: Chevron Research Company, San Francisco, Calif.

[21] Appl. No.: 501,200

[22] Filed: Jun. 6, 1983

[51] Int. Cl.[3] ..... C10G 1/00

[52] U.S. Cl. ..... 208/8 LE; 110/218; 110/229; 208/11 LE

[58] Field of Search ..... 110/347, 263, 218, 341, 110/342, 229; 44/1 R; 208/8 LE, 11 LE

[56] References Cited

U.S. PATENT DOCUMENTS

| | | | |
|---|---|---|---|
| 3,523,886 | 8/1970 | Gorin et al. | 208/8 LE |
| 4,260,471 | 4/1981 | Miller | 208/8 LE |
| 4,424,108 | 1/1984 | Braumlim et al. | 208/8 LE |
| 4,437,973 | 3/1984 | Huibers et al. | 208/8 LE X |

*Primary Examiner*—Edward G. Favors

*Attorney, Agent, or Firm*—Burns, Doane, Swecker & Mathis

[57] ABSTRACT

A system for transferring solid material to and from a high pressure reactor as a water slurry is disclosed. In a wet oxidation reaction system comminuted solid hydrocarbonaceous material, such as shale, coal, tar sand, wood or waste, flows in a continuous circulation loop to mix and supply a slurry of water and a high concentration of comminuted solid hydrocarbon-containing particles to the reactor. Such a slurry is reacted with oxygen at high temperature and pressure to extract hydrocarbon fluids as a gaseous phase and to remove metal, sulfur and nitrogen components from the material in the residual liquid. Flow into and out of the reactor vessel is through hydraulically actuated cylinders each isolated from atmosphere and the reaction vessel by a pair of full flow gate valves having no valve seats, throats or stems subject to abrasion.

7 Claims, 2 Drawing Figures

SYSTEM FOR TRANSFERRING A SLURRY OF HYDROCARBON-CONTAINING SOLIDS TO AND FROM A WET OXIDATION REACTOR

BACKGROUND OF THE INVENTION

1. Field of the Invention

The present invention relates to wet oxidation of solid hydrocarbon containing materials, such as shale, coal, tar sand, wood and waste particles, or catalyst particles, or both. More particularly, it relates to a method of controlling feed of any solid materials on a batch or periodic basis to a high pressure, high temperature reactor for such oxidation or other hydrocarbon reaction and removal of the unreacted solid material from the reactor so that additional hydrocarbon containing material may be added.

2. Description of the Prior Art

It has been the practice in extracting hydrocarbon fluids from hydrocarbon containing solids by a wet oxidation process to form the feed to the reactor as a substantially homogeneous slurry of the solid and water. Such a slurry may be more readily pumped than a heterogeneous mixture of such solids and water. The slurry is periodically charged to a reactor where hydrocarbon fluid is extracted at high temperatures and pressures by the water and oxygen, such as air, carbon monoxide or molecular oxygen. Efficient hydrocarbon fluid extraction in such a wet oxidation process requires pressures of from about 220 psi up to about 5200 psi and temperatures of from 350° F. up to about 900° F. or higher.

A slurry of solid hydrocarbon containing materials either homogeneous or heterogeneous, is formed by (1) comminuting or reducing the solids to relatively uniform particle sizes, and (2) mixing the reduced solids with enough liquid to form a pumpable viscous mixture, and generally, (3) adding a hydrocarbon fluid to assist formation and suspension of particles in such a slurry, and where required, to add necessary heat to carry out the reaction process.

A particular value of converting such solid carbonaceous materials to fluid hydrocarbons is that they are usable, directly as transportation liquids or for further hydrocarbon processing. It is known that both organic and non-organic compounds, such as those of sulfur, nitrogen, iron and other metals in such hydrocarbon-containing materials may be removed through solution in the water phase of the reacted mixture so that the hydrocarbon may be more easily converted, as by catalysis to more valuable products.

Slurries, formed as indicated, are particularly abrasive to pumps, conduits and valves that control admission of batch or discrete quantities of the mixture to a high pressure reaction chamber. These conduits and valves are essential to take the solid particles from atmospheric conditions to the reaction chamber pressures, and vice versa, to release and dispose of the hydrocarbon depleted residue, such as sand, shale or char. In particular, we have found that it is essential to maintain the slurry in a well mixed condition to control the amount and quality of particulate material charged to the reactor. For efficient operation the slurry desirably contains a high percentage of solids of from 5% to 90%, but preferably from 10% to 40%. However, such high concentrations of solids are difficult to hold in suspension and highly abrasive to the pumping system at such high pressures. Further, we have found that valves for such service which contain any obstructions to flow, such as valve seats, throats or stems, act as throttling elements and are easily destroyed by slight pressure differences across the valve while such a slurry is being transferred into or out of the pressure chamber. Similarly, check valves or gate valves forming flow restrictions relative to the flow conduits are subject to abnormal deterioration. Additionally variable volume chambers formed by flexible diaphragms or inflatable chambers, either external or internal to the slurry, present difficult maintenance and durability problems for long term operation of such a system.

Examples of such prior known systems for wet oxidation of hydrocarbon containing solids include: U.S. Pat. No. 4,211,174—Martin et al. This patent discloses a coal slurry system in which an aqueous slurry includes only 0.5 to 3 weight percent coal pulverized to a particle size not over about 0.02 inch. The slurry is then pumped by a high pressure pump into a reaction vessel through a plurality of check valves. U.S. Pat. No. 3,891,352—Tsukamoto, discloses a similar slurry pumping system employing check valves in two valve bodies to alternately pump the slurry in a pipe line.

U.S. Pat. Nos. 3,824,084—Dillon et al, and 4,174,953—Sun et al, disclose preparation of a coal slurry by pulverization and suspension in water to remove sulfur components by wet oxidation. U.S. Pat. No. 3,912,626—Ely et al is an example of wet oxidation of sewage sludge. U.S. Pat. No. 4,247,384— Chen et al is directed to a method of liquefaction of wood or coal by wet oxidation. U.S. Pat. No. 4,013,560—Pradt discloses wet oxidation systems for incineration of combustible waste and power generation.

U.S. Pat. No. 4,174,280—Pradt et al, recognizes that certain organic containing solid materials are largely insoluble, immiscible and difficult to suspend or emulsify in water. The patentees propose to pump a very heavy slurry of liquid and solid with a cavity pump or a dry feeder into a high pressure reactor.

U.S. Pat. No. 4,100,730—Pradt also discloses energy recovery by wet oxidation of a combustible material, solid or liquid, from a water slurry. U.S. Pat. No. 4,197,090—Yoo et al discloses sulfur removal from a coal and water slurry by oxidation with heat and pressure. U.S. Pat. No. 3,876,497—Hoffman discloses a similar wet oxidation process to treat paper mill waste sludges. None of the foregoing patents recognize the problem of slurry feed and valve wear in batch or semi-continuous introduction of slurry into a high pressure and high temperature reactor, or removal of spent material from the reactor vessel.

Examples of systems disclosing use of diaphragm members for pumping solid material include: U.S. Pat. No. 4,106,533—Herzig. This patent discloses a high pressure (up to 365 psig) gasification system in which comminuted solid particles such as coal dust are fed through parallel tubes. Each tube includes an inflatable diaphragm actuated externally by hydraulic pressure means to supply particles to a screw conveyor feeding the gasification reactor. Rotatable gate valves open and close the ends of the parallel diaphragm tubes.

U.S. Pat. No. 3,393,944—Reintjes is directed to a plunger actuated feed chamber for a coal gasification system. The coal is in the form of pulverized dry solid particles. The plunger includes an elastomeric sleeve forming a diaphragm that may be expanded or contracted to pump the dry particles into a reaction chamber.

U.S. Pat. No. 4,159,150—Rachais discloses a lock hopper system for a subatmospheric pressure vessel such as a vacuum jet mill, used in grinding cement clinker to powder. The dry material flows by gravity and vacuum with the aid of vibrators.

Systems for hydraulically pumping abrasive slurries of solid particles using check valves include, U.S. Pat. No. 3,091,352—Tsukamoto and U.S. Pat. No. 4,304,527—Jewell et al.

U.S. Pat. No. 3,804,556—Katzer et al is directed to a mud pump using a floating piston hydraulic system in which a sliding valve is opened and closed in synchronism with the pump stroke for intake and discharge.

SUMMARY OF THE INVENTION

It is a particular object of the present invention to provide a hydrocarbon reaction system, such as a wet oxidation process, to extract hydrocarbons or soluble materials from heterogeneous solid materials in a well dispersed slurry that is formed and fed without use of a bladder or flexible diaphragm to pump said slurry, and without abrasion or undue wear of the mechanical check or pressure control valves and conduits to regulate flow from an atmospheric source to a high pressure reaction chamber. Such system also serves to return spent solids to atmospheric conditions after such reaction. In accordance with the invention a supply of comminuted, or finely ground, solid hydrocarbon containing material is formed into a liquid slurry by mixing and continuously pumping the mixture in a closed circulation loop. A first, or charge forming, pressure chamber is filled through a full flow self-wiping ball-type gate valve opening into a diversion line from the closed circulation loop. The ball-type gate valve has a flow area equal to the area of the conduit carrying the material through the valve and to the first variable volume charge chamber. Such gate valve includes a rotabable ball carrying such full flow passageway in a resilient body that wipes the ball clean of solid material each time it is rotated to open or close. Further, the gate may only be opened when the pressure in said chamber is equal to the pressure in said diversion line. Flow from the closed circulaton loop may be diverted to flow through the gate valve by a slight reduction in pressure in the charging chamber. After filling, the gate valve is closed and pressure is then raised in the pressure, or charge chamber to equal substantially the pressure in the reactor. A conduit from the pressure chamber to the reactor includes a second full flow gate valve and the pressure across the second valve is equalized before it is opened. A slurry of heterogeneous solid material and water is hydraulically pumped into the reaction chamber by reducing the volume of the charge chamber.

The slurry is then reacted at a pressure from 220 psig to 5200 psig and at a temperature of from 350° F. to 900° F. in the presence of oxygen to extract fluid hydrocarbon components from the solid material and/or to dissolve water extractable materials into the liquid. The reaction time is controlled for maximum efficient recovery of product or elimination of undesirable components such as metals in the water phase.

Residual solid material is then removed through a similar arrangement of another or second variable volume pressure chamber isolatable from the reactor and atmosphere by a second pair of full flow gate valves. The pressure chamber is first brought to a pressure substantially equal to the reactor pressure, and the third (or first of the second pair) full flow valve is opened. The volume of the pressure chamber is increased to withdraw a known quantity of fluid including spent solid material. The third full flow gate valve is then closed and the pressure in the second pressure chamber is reduced to substantially atmosphere. The fourth (or the other of the second pair) full flow gate valve is then opened and the volume of the second pressure chamber is reduced to pump the residue from the system.

Further objects and advantages of the present invention will become apparent from the following detailed description of the preferred embodiments when read with the accompanying figures of the drawings which form an integral part of this specification.

BRIEF DESCRIPTION OF THE DRAWINGS

Referring to the drawing, FIG. 1 illustrates in schematic form a wet oxidation reaction vessel 10 formed as a pressure reactor chamber. A slurry of comminuted solid material containing hydrocarbon components and water are reacted in vessel 10 with oxygen at elevated temperatures and pressures. An external heat source is not shown since such a process is autogenic by the heat of reaction of the hydrocarbon and oxygen. Initial heat may be added by steam, as through line 12. The oxidation reaction with the hydrocarbon components is performed by supplying oxygen, preferrably as molecular oxygen, by gas line 14. Other oxygen containing gas may be used, for example air or carbon monoxide or mixtures thereof with oxygen. After suitable reaction time at pressures of from about 150 psig to 5200 psig and at a temperature of up to about 900° F., fluid hydrocarbon product in the form of vapor is withdrawn through offtake line 16. Such product may be distilled or fractionated to recover desirable liquid and gaseous hydrocarbon products. At the same time water soluble components, such as sulfur or metal oxides may be recovered from the extracted hydrocarbon or solid material in the residual water. Such water is withdrawn with any solid residue from vessel 10.

Figures 1, 2:
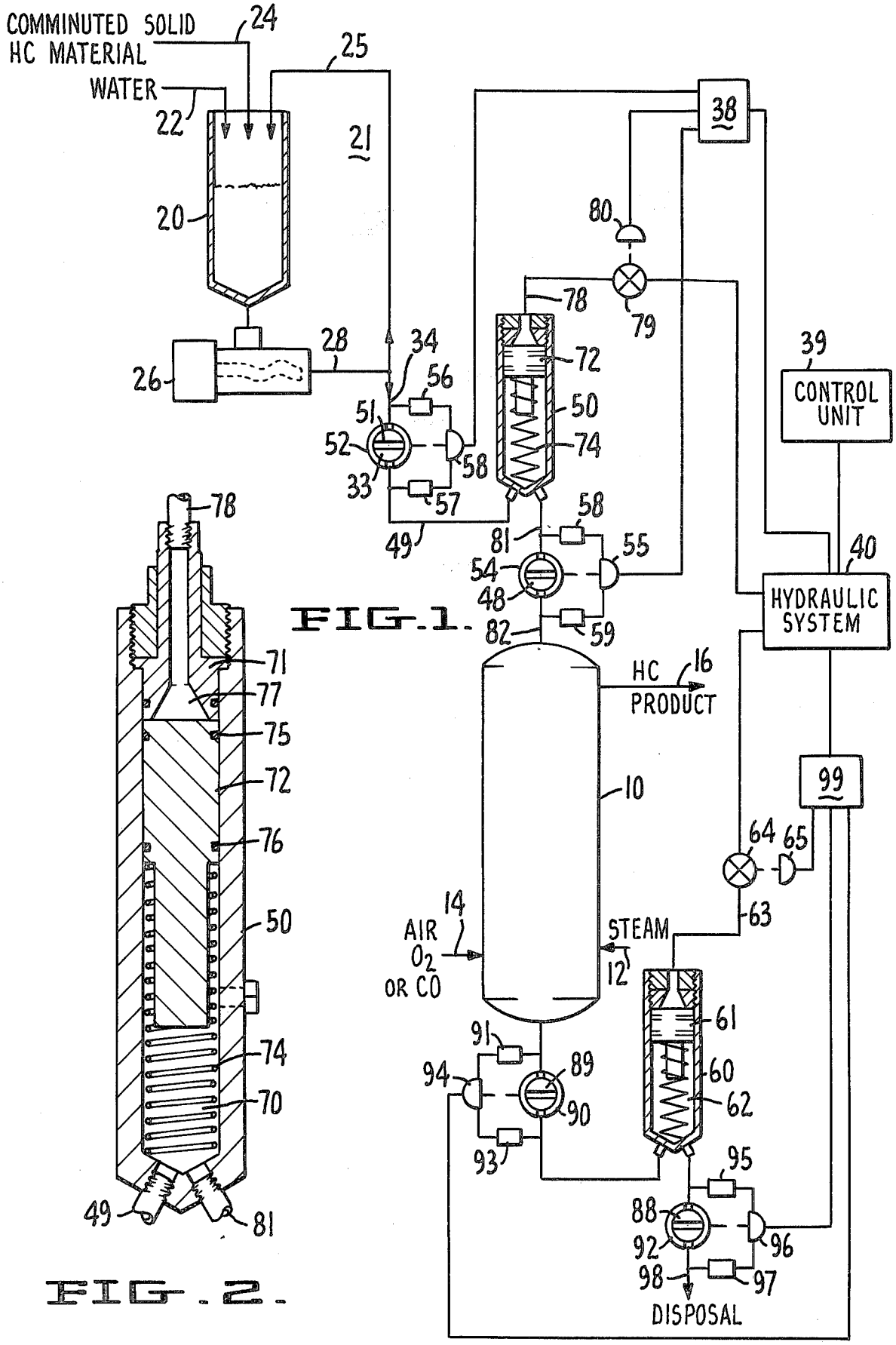
FIG. 1 is a schematic representation of a hydrocarbon fluid extraction system for wet oxidation of solids containing hydrocarbon material such as coke, coal, shale, tar sands or waste material which have been comminuted and suspended in fluid as a pumpable slurry.
FIG. 2 is a vertical cross-sectional view of a preferred form of a variable volume pressure chamber particularly useful in practice of the method of the present invention.

A particular problem in supplying solid particulate material to reactor 10 lies in preparation and feeding of the slurry to such a reactor on a semicontinuous or batch basis without stopping and starting the system.

While it has been known to open and close lock chambers for raising any feed material to reaction temperature and pressure conditions inside reactor vessel 10, it is difficult to both form and supply a consistent slurry of hydrocarbon containing solid particles and liquid to such a wet oxidation reactor vessel on a batch or intermittent basis. In accordance with the present invention, such problems are obviated by first forming and continuously flowing a slurry mixture through a closed loop. Loop 21 indicated in FIG. 1 includes mixing hopper 20 to which water is added from line 22 with or without a small amount of a hydrocarbon liquid. Finely ground or comminuted solid particles containing hydrocarbonaceous material is introduced into mix or slurry hopper 20 from a dry hopper or source (not shown), as indicated by line 24. The resulting mixture from hopper 20 continuously flows through a single, screw actuated pump 26 which both mixes and pumps the slurry through line 28 and back through line 25 to complete loop 21. Desirably pump 26 is a Monyo-type capable of passing solid particles of varying size. By continuous recirculation, particles are uniformly dispersed in the slurry so that the fluid to be fed to reactor 10 has a substantially uniform viscosity and the particles are substantially equally dispersed in the slurry.

Reactor vessel 10 is arranged to be both charged and discharged through a pair of full flow gate valves 54 and 90, respectively, and variable volume chambers 50 and 60, respectively. Entry into and out of both chambers 50 and 60 is controlled by another pair of similar gate valves 52 and 92 respectively. As indicated, and as discussed above, preferably, valves 52 and 54 and valves 90 and 92 are each full flow gate valves having a full flow passage, such as 51 in valve 52, whose diameter is at least as large as inlet conduit 34 and outlet conduit 49. Desirably, valve 52 (for example) has a ball or rotary gate element 33 in which flow passage 51 is formed. Ball 33 is packed within valve 52 so that the outer surface thereof is wiped by such packing each time the ball rotates to open or close passageway 51 to flow. In this way, wear of ball 33 by granular material such as tar sand or shale particles is minimized for long service life. A full flow slide gate may also be employed if desired. The particular virtue of such full flow gate valves is to avoid flow of abrasive material through partially opened or throttled flow passages and most especially when flow across such partially opened passageways is at high velocity due to high pressure differentials thereacross. Rotary gate element 33 may be operated by fluid pressure, as indicated schematically by hydraulic unit 53 through controller 38 regulating fluid flow from hydraulic system 40. Control of the entire system may be through control unit 39.

In the case of variable volume chamber 50, slurry to reactor 10 is charged through valves 52 and 54, controlled by hydraulic operators 53 and 55, respectively. Operator 55 for valve 54 is also supplied through controller 38 and hydraulic system 40. Control of operators 53 and 55 are further under control of a pair of differential pressure sensing or measuring devices 56 and 57 for controller 53. Pressure sensors 58 and 59 similarly control operator 55 to actuate valve 54. The function of pressure detectors 56 and 57 is to assure that the pressure difference across valve 52 is substantially zero before operator 53 is actuated to open fully gate element 33 of valve 52. Pressure detectors 58 and 59 across valve 54 likewise control operator 55 to prevent rotation of gate element 48 until the pressure across valve 54 is substantially zero.

In forming a charge of well mixed slurry to supply reactor 10, valve 52 is opened so that slurry may be drawn into charge chamber 50 through line 49 by a small reduction in pressure of chamber 50. As best seen in FIG. 2 the structure of variable volume charge chamber 50 includes cylinder 70 wherein free-floating piston 72 is biased to an open position by spring 74. Piston 72 is slidably sealed in cylinder 70 by O-rings 75 and 76 and to provide self wiping of the wall of cylinder 70 with each reciprocation of piston 72. The lower portion of cylinder 70 is filled with a charge of slurry, as defined by the fully retracted position of floating piston 72. After filling variable volume chamber 50, actuator 53 again closes valve 52 to isolate the charge in cylinder 70 between valves 52 and 54. The pressure is then increased in chamber 50 by actuation of hydraulic controller 38 to activate operator 80 to admit hydraulic fluid through intake line 78 and valve 79. Pressure is then increased in the upper end of chamber 50 through conical section 77 in head 71 which then increases pressure on the slurry charge. Such pressure is increased until pressure detectors 58 and 59 indicate that the pressure difference across valve 54 is equal in outflow line 81 and input line 82 to reactor 10. Actuator 55 for valve 54 then is free to rotate gate 48 to a fully open position. The charge is pumped into reactor 10 by displacement of piston 72 against spring 74 in chamber 50 by hydraulic pressure from system 40.

A second pair of valves indicated as 90 and 92 are respectively operated by hydraulic operators 94 and 96 through a similar hydraulic controller 99, also operative through hydraulic system 40. When spent or residual particles are to be removed from reactor 10, the pressure difference across valve 90 is detected by pressure sensors 91 and 93. This prevents opening of valve 90 through operator 94 until such pressure is fully equalized between chamber 60 and reactor 10. Upon such equalization the volume of variable volume chamber 60 is filled with spent material. As indicated chamber 60 is preferrably identical in structure to chamber 50. Valve 90 is again closed to isolate the charge in chamber 60. Release of spent material from chamber 60 to discharge line 98 is through valve 92, actuatable by operator 96 in response to the pressure detectors 95 and 97 indicating no substantial difference in pressure. Actuation of piston 61 in cylinder 62 of chamber 60 is controlled by hydraulic fluid, regulated through intake line 63 under the control of valve 64 actuated by operator 65.

While each pair of full-flow gate valves for chambers 50 and 60 may be manually controlled, desirably valves 52 and 54 for chamber 50 and valves 90 and 92 for chamber 60 are controlled in synchronism with each other. For example chamber 50 may be filled while chamber 60 is beng emptied. Similarly upon transfer of slurry from chamber 50 to reactor 10, spent material may be discharged from reactor 10 to chamber 60. However in each case such transfers can only occur when the pressure difference across any of the two pairs of valves is essentially zero. Such restriction assures that full flow will occur with minimum wear on the gate valve elements (51, 53, 88 and 89) and conduits. Further, the slurry is well dispersed during transfer from the closed circulation loop as well as through charge chambers 50 and 60 and reactor 10.

It will also be apparent that although the differential pressure measuring arrangement has been shown as individual sensors, such as 56 and 57 across valve 52, control may also be in accordance with pressures in slurry circulation loop 21, chamber 50 and reactor 10 to energize operator 53 for gate valve 52. Similarly, the pressure in discharge chamber 60, reactor 10 and discharge line 98 may be used to actuate operators 94 and 96, respectively, to rotate gate 89 of valve 90 or gate 88 of valve 92.

Various modifications and changes in the method and apparatus of the present invention will become apparent to those skilled in the art from the above described embodiments. All such modifications or changes coming within the scope of the appended claims are intended to be included therein.

We claim:

1. A method of improving the reaction of solids containing hydrocarbonaceous material with water in the presence of oxygen at high temperatures and pressures in a reactor vessel to recover a fluid hydrocarbon from said solids which comprises:

forming a slurry of comminuted solid hydrocarbonaceous material selected from the group consisting of coke, coal, shale, tar sands and hydrocarbon containing waste material in a liquid, continuously circulating said slurry in a closed flow loop to maintain dispersion of solid material in the liquid of said slurry, diverting a portion of said flowing slurry to fill a first variable volume chamber, said first chamber during filling being isolated from fluid flow communication with a reaction vessel wherein said solid hydrocabonaceous material is to be reacted for a given time to extract hydrocarbon fluids from said solid material;

sealing off said slurry in said first chamber from said flow loop;

increasing the pressure on said slurry in said first chamber to equal substantially the pressure in said reaction vessel;

balancing the pressure in a flow conduit between said vessel and said chamber across a full-flow gate valve controlling flow through said conduit;

then opening said gate valve for full flow of said slurry including said solid material from said chamber into said vessel;

again increasing the pressure in said first chamber to move said slurry therein into said reaction vessel;

reacting said slurry mixture in said reaction vessel with oxygen flowing through said slurry in said vessel for a predetermined time at elevated temperature and pressure conditions to extract hydrocarbon fluid from said solids;

balancing the pressure in another vertical conduit between said reaction vessel and a variable volume discharge chamber below said vessel, said other conduit including another full flow gate valve for controlling flow therethrough; said variable volume discharge chamber being isolated by another gate valve from atmosphere during said pressure balancing;

then opening said other gate valve for full flow of the solid residue from said reaction vessel to said variable volume discharge chamber to fill said discharge chamber with at least a portion of the residual solid content of said vessel at said elevated pressure of said vessel;

closing said other gate valve to isolate said solid residue in said discharge chamber and reducing the pressure therein to substantially atmospheric; and then opening said other gate valve to release the contents of said discharge chamber at substantially atmospheric pressure.

2. A method of improving the wet oxidation reaction of solids containing hydrocarbonaceous material with water and oxygen at high temperatures and pressures to recover a hydrocarbon fluid from said solids and solution of water soluble oxides in the liquid of said slurry which comprises:

forming a pumpable slurry of water and comminuted solid hydrocarbonaceous material, continuously mixing and circulating said pumpable slurry in a closed pumping loop, charging a first pressure chamber by opening a first flow conduit communicating with said slurry circulation loop, diverting at least a portion of said flow to said first pressure chamber through said first conduit, said first conduit including a first valve having a full flow area substantially equal to the area of said conduit;

closing said first valve to isolate said first chamber from the atmosphere;

increasing the pressure in said first pressure chamber to a pressure substantially equal to the pressure in a second conduit connected to a reaction vessel wherein said solid hydrocarbonaceous material is to be reacted with an oxygen containing gas at a pressure of from about 150 psig to 5200 psig to extract hydrocarbon fluid from said solid material;

balancing the pressure difference to substantially zero between said second conduit and said first chamber across a second valve in said second conduit, said valve having a flow area substantially equal to that of said conduit;

then, fully opening said second valve for communication at said elevated pressure between said first chamber and said vessel and increasing the pressure on said slurry in said first chamber to charge said sluury into said vessel;

reacting said slurry for a predetermined time at a temperature of from about 350° C. to 900° C. at a pressure of from 150 psig to 5200 psig in the presence of oxygen to extract said hydrocarbon fluid from said solid material;

increasing the pressure of liquid in a third conduit between said reaction vessel and a discharge chamber to equal the pressure in said vessel so that the pressure difference across a third full flow valve is substantially zero, opening said third valve for full liquid communication between said reaction vessel and said discharge chamber, closing said third valve to isolate said third conduit and said discharge chamber from said vessel, said chamber being isolated from atmosphere by a fourth line having a full flow valve controlling flow therethrough;

decreasing the pressure in said discharge chamber to substantially atmospheric pressure by balancing the pressure difference across said fourth full flow valve to substantially zero, and then, opening said fourth full flow valve and increasing the pressure in said discharge chamber to remove at least a portion of the solid residue and any soluble products in the slurry generated in the reaction process.

3. The method of claim 2 wherein said comminuted solid hydrocarbonaceous material is selected from the group consisting of coke, coal, shale, tar sand, plant and biological waste matter.

4. The method of claim 2 wherein said slurry is by volume from 5% to 90% solids and from 95% to 10% water.

5. The method of claim 2 wherein said solid material is 60% to 80% of the volume of said slurry.

6. Apparatus for transferring a slurry of comminuted solid particles containing hydrocarbonaceous material and water into and out of a reactor for wet oxidation of said slurry at high temperature and pressure to recover a fluid hydrocarbon from said solids with or without solution of water soluble components in the slurry which comprises:

hopper means for storing a slurry of comminuted solid hydrocarbonaceous material selected from the group consisting of coke, coal, shale, tar sands and hydrocarbon containing waste material and liquid, means for mixing and continuously circulating slurry from said hopper means through a closed flow loop at a rate sufficient to maintain dispersion of solid material in the liquid of said slurry, means for diverting a portion of said flowing slurry from said loop to fill a first variable volume chamber means, said first variable chamber means having a cylinder formed therein, a floating piston reciprocable cylinder, spring means in one end of said cylinder for biasing said piston toward the other end of said cylinder, hydraulic pressure means at the opposite end of said cylinder for actuating said piston against said spring means, and inlet and outlet means to said cylinder at said one end;

first conduit means for flow of slurry to said cylinder inlet means from said flow loop;

first gate valve in said first conduit, means for operating said first gate valve in response to the pressure thereacross being substantially zero, means for actuating said hydraulic means to increase the pressure on said slurry in said chamber means to equal substantially the pressure in said reaction vessel after closure of said first valve;

a second flow conduit connected between a reaction vessel and the outlet means from said chamber cylinder, a second full-flow gate valve for controlling flow through said second conduit;

control means for actuating said second gate valve;

means for increasing the hydraulic pressure on said piston to raise the pressure of slurry in said first chamber cylinder to equal substantially the pressure in said reaction vessel;

means for actuating said second gate valve control means in response to equalization of pressure across said second gate valve to admit slurry to said reactor vessel;

means for heating said slurry mixture in said reaction vessel to initiate controlled combustion therein including means for flowing oxygen through said slurry in said vessel for a predetermined time at elevated temperature and pressure conditions to extract hydrocarbon fluid from said solids;

a third conduit between said reaction vessel and the inlet means of the cylinder of another variable volume chamber means, said third conduit including a third full flow gate valve for controlling flow therethrough; said variable volume chamber means being isolated from atmospheric pressure by fourth conduit means between the outlet means for said cylinder and atmosphere, a fourth full flow gate valve for controlling flow through said fourth conduit, and means for controlling said third and fourth gate valves for full flow of solid residue from said reaction vessel to the cylinder of said other variable volume chamber means to fill said cylinder with at least a portion of the residual solid content of said vessel at said elevated pressure of said vessel;

means responsive to the pressure difference across said third gate valve being substantially zero to isolate said solid residue in said cylinder of said other chamber, means for controlling the hydraulic pressure on a piston in said cylinder to reduce the pressure therein to substantially atmospheric;

means for opening said fourth gate valve when the pressure difference thereacross is substantially zero, and means responsive to opening of said fourth gate valve to increase the pressure in the cylinder said other variable volume chamber means to discharge the contents thereof at substantially atmospheric pressure.

7. Apparatus for improving wet oxidation of hydrocarbonaceous material which comprises a reactor vessel for wet oxidation of a slurry of water and comminuted solids containing hydrocarbon material at elevated temperatures and pressures in the presence of oxygen;

a pair of variable volume transfer chambers, one of said chambers forming slurry charging means for said reactor, the other chamber forming discharge means for said reactor, each of said transfer chambers including hydraulically actuable floating piston means for controlling the pressure of slurry therein;

first conduit means connected to one of said chambers to the inlet of said reactor vessel and second conduit means connecting the other of said chambers to the outlet of said reactor vessel;

a full-flow gate valve in each of said reactor conduits, said valves being controllable to open and close only when the pressure thereacross is substantially equal;

each of said chambers including an additional transfer conduit connected for flow of slurry therethrough, each of said transfer conduits including a full-flow gate valve controllable to open and close only when the pressure threacross is substantially zero;

means for circulating said slurry in a closed loop;

means for diverting a portion of the slurry flow in said loop into said slurry charging chamber when said full-flow gate valve in said transfer conduit controlling flow in said first conduit is open;

automatic control means for selectively controlling the opening of each of said full-flow gate valves in response to the pressure thereacross being substantially zero for transfer of slurry between said variable volume chambers and said reactor vessel; and means for actuating said floating piston means in each of said chambers in response to opening of one of said valves in a conduit connected thereto whereby each transfer of slurry particles through said gate valves and conduits is only after the pressure difference across any of said valves is essentially zero.

* * * * *